US008387334B2

(12) United States Patent
Gulati et al.

(10) Patent No.: US 8,387,334 B2
(45) Date of Patent: Mar. 5, 2013

(54) LNG CONTAINMENT SYSTEM AND METHOD OF ASSEMBLING LNG CONTAINMENT SYSTEM

(75) Inventors: Kailash C. Gulati, Houston, TX (US); Thomas A. Ballard, Campbell, CA (US); Alexander V. Krimotat, Los Gatos, CA (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 12/903,879

(22) Filed: Oct. 13, 2010

(65) Prior Publication Data

US 2011/0023408 A1 Feb. 3, 2011

Related U.S. Application Data

(62) Division of application No. 10/593,457, filed as application No. PCT/US2005/017363 on May 17, 2005, now Pat. No. 7,837,055.

(60) Provisional application No. 60/572,736, filed on May 20, 2004.

(51) Int. Cl.
*E04B 1/00* (2006.01)
*E04G 21/00* (2006.01)
*E04G 23/00* (2006.01)

(52) U.S. Cl. ..... 52/741.12; 52/223.2; 52/246; 220/476; 220/560.1; 220/560.12; 220/560.04; 220/560.08; 220/901; 220/4.12; 62/45.1

(58) Field of Classification Search ..... 220/560.04, 220/901, 560.08, 560.11, 560.07, 560.05, 220/476, 4.12, 4.09, 4.07; 52/247, 249, 573.1, 52/741.12, 223.2, 246; 62/45.1
See application file for complete search history.

(56) References Cited

U.S. PATENT DOCUMENTS 1,477,686 A * 12/1923 Braender ..... 220/560.02
1,631,051 A 5/1927 Nichols
2,296,414 A 9/1942 Albrecht (Continued)

FOREIGN PATENT DOCUMENTS

DE 26 36 622 A1 2/1978
EP 0 013 624 A2 7/1980

(Continued)

OTHER PUBLICATIONS

European Search Report No. RS 111540, Oct. 7, 2004, 6 pages.

(Continued)

*Primary Examiner* — Joshua J Michener
*Assistant Examiner* — Chi Q Nguyen
(74) *Attorney, Agent, or Firm* — ExxonMobil Upstream Research Company Law Department

(57) ABSTRACT

An LNG system generally comprises a primary container, and a secondary container positioned around the primary container. The secondary container generally comprises a first end wall, a second end wall, and at least two side walls. At least one of the walls is fabricated from a plurality of prefabricated wall panels. Each of the wall panels is fabricated from a combination of concrete and steel. The wall panels are preferably prefabricated offsite, and then transported to the construction site where they are adjoined together in end-to-end fashion to form walls. A method for constructing a full containment LNG system is also provided. In one embodiment, walls and a roof for a secondary container are assembled, but leaving an end open. At least one primary tank is brought into the secondary container. A second end wall is then erected to form the enclosure for the secondary container.

13 Claims, 8 Drawing Sheets

U.S. PATENT DOCUMENTS

| | | | | | |
|---|---|---|---|---|---|
| 2,331,483 | A | | 10/1943 | Lawman et al. | |
| 2,337,049 | A | | 12/1943 | Jackson | |
| 2,911,125 | A | * | 11/1959 | Dosker | 220/560.05 |
| 2,982,441 | A | | 5/1961 | Farrell et al. | |
| 3,062,402 | A | | 11/1962 | Farrell et al. | |
| 3,319,431 | A | | 5/1967 | Clarke et al. | |
| 3,441,164 | A | | 4/1969 | Wang | |
| 3,488,972 | A | | 1/1970 | Closner | |
| 3,538,661 | A | * | 11/1970 | Nelson | 52/246 |
| 3,559,835 | A | * | 2/1971 | Lange | 220/560.12 |
| 3,595,423 | A | * | 7/1971 | Yamamoto | 220/560.05 |
| 3,633,328 | A | | 1/1972 | Closner | |
| 3,721,362 | A | | 3/1973 | Bridges et al. | |
| 3,754,675 | A | | 8/1973 | Richard et al. | |
| 3,799,383 | A | * | 3/1974 | Gerhard | 220/1.5 |
| 3,800,970 | A | | 4/1974 | Jackson | |
| 3,811,593 | A | | 5/1974 | Bridges et al. | |
| 3,828,708 | A | | 8/1974 | Gerwick, Jr. et al. | |
| 3,852,973 | A | | 12/1974 | Marothy | |
| 3,863,408 | A | | 2/1975 | Closner et al. | |
| 3,926,134 | A | * | 12/1975 | Closner et al. | 114/74 R |
| 3,935,957 | A | * | 2/1976 | Hasegawa | 220/560.1 |
| 3,996,717 | A | | 12/1976 | Sallenave et al. | |
| 4,041,722 | A | | 8/1977 | Terlesky et al. | |
| 4,069,642 | A | | 1/1978 | Hendriks | |
| 4,075,801 | A | | 2/1978 | Alper et al. | |
| 4,117,947 | A | * | 10/1978 | Androulakis | 220/560.08 |
| 4,207,827 | A | | 6/1980 | Gondouin | |
| 4,225,054 | A | | 9/1980 | Jean | |
| 4,282,619 | A | | 8/1981 | Rooney | |
| 4,308,967 | A | | 1/1982 | Vater et al. | |
| 4,344,264 | A | | 8/1982 | Smith | |
| 4,366,654 | A | * | 1/1983 | Bomhard | 52/223.2 |
| 4,492,087 | A | * | 1/1985 | Schafer et al. | 62/45.1 |
| 4,498,304 | A | | 2/1985 | Guilhem | |
| 4,513,550 | A | | 4/1985 | Kotcharian | |
| 4,651,401 | A | | 3/1987 | Arbella | |
| 4,951,437 | A | | 8/1990 | Rozzi | |
| 5,081,761 | A | | 1/1992 | Rinehart et al. | |
| 5,375,547 | A | | 12/1994 | Abe et al. | |
| 5,464,116 | A | | 11/1995 | Aoki et al. | |
| 5,501,359 | A | | 3/1996 | Chauvin et al. | |
| 5,505,035 | A | | 4/1996 | Lalvani | |
| 5,590,497 | A | | 1/1997 | Moore | |
| 5,662,264 | A | | 9/1997 | Gustafsson et al. | |
| 5,695,089 | A | | 12/1997 | Reese et al. | |
| 5,791,107 | A | | 8/1998 | Danisch et al. | |
| 5,809,650 | A | | 9/1998 | Reese et al. | |
| 6,012,292 | A | | 1/2000 | Gulati et al. | |
| 6,202,376 | B1 | | 3/2001 | Guiton | |
| 6,244,053 | B1 | | 6/2001 | Gulati et al. | |
| 6,378,722 | B1 | | 4/2002 | Dhellemmes | |
| 6,422,413 | B1 | | 7/2002 | Hall et al. | |
| 6,484,464 | B1 | | 11/2002 | Ochoa | |
| 6,673,412 | B2 | | 1/2004 | Ramesh et al. | |
| 6,675,731 | B2 | | 1/2004 | Dhellemmes | |
| 6,729,492 | B2 | | 5/2004 | Gulati | |
| 6,732,881 | B1 | | 5/2004 | Gulati | |
| 7,837,055 | B2 | * | 11/2010 | Gulati et al. | 220/476 |

FOREIGN PATENT DOCUMENTS

| | | | |
|---|---|---|---|
| EP | 0 689 897 | B1 | 6/1995 |
| EP | 0 628 763 | B1 | 3/1996 |
| EP | 1 106 903 | A1 | 6/2001 |
| FR | 1.383.795 | | 12/1965 |
| FR | 2 737 767 | A1 | 2/1997 |
| GB | 1053591 | | 1/1967 |
| GB | 1 554 113 | | 10/1979 |
| JP | 62132098 | A | 6/1987 |
| JP | 03056797 | A | 3/1991 |
| JP | 04113099 | A | 4/1992 |
| JP | 07034712 | A | 2/1995 |
| JP | 2000336969 | A | 12/2000 |
| WO | WO 95/26482 | | 10/1995 |
| WO | WO 00/21847 | | 4/2000 |
| WO | WO 02/48602 | A1 | 6/2002 |
| WO | WO 02/081297 | A2 | 10/2002 |

OTHER PUBLICATIONS

PCT International Search Report and Written Opinion for PCT/US05/17363, mailed Jan. 13, 2006, 7 pages.

U.S. Appl. No. 10/593,457 Office Action mailed Nov. 12, 2009.

U.S. Appl. No. 10/593,457 Office Action mailed Jan. 5, 2010.

U.S. Appl. No. 10/593,457 Notice of Allowance Jul. 20, 2010.

* cited by examiner

LNG CONTAINMENT SYSTEM AND METHOD OF ASSEMBLING LNG CONTAINMENT SYSTEM

CROSS REFERENCE TO RELATED APPLICATION

This application is a divisional application under 35 U.S.C. §121 of, and claims priority under 35 U.S.C. §120 to, U.S. patent application Ser. No. 10/593,457, which issued as U.S. Pat. No. 7,837,055, entitled LNG CONTAINMENT SYSTEM AND METHOD OF ASSEMBLING LNG CONTAINMENT SYSTEM, filed on 10 Apr. 2007, which application is the national phase application under 35 U.S.C. §371 of international application PCT/US05/17363, filed 17 May 2005, which application claims the benefit under 35 U.S.C. §119(e) of U.S. Provisional Application 60/572,736, filed 20 May 2004. The entirety of each of these applications is incorporated herein by reference for all purposes.

BACKGROUND

1. Field of the Inventions

Embodiments of the present invention generally relate to the storage of large fluid volumes. More particularly, embodiments of the present invention relate to tank designs for holding hydrocarbons. In addition, embodiments of the present invention relate to the manufacture of an LNG containment system.

2. Description of Related Art

Clean burning natural gas has become the fuel of choice in many commercial and consumer markets around the industrial world. Such natural gas is oftentimes transported across oceans from the sites of production to consuming nations. Such transportation of natural gas typically occurs over long distances using large-volume marine vessels.

In order to facilitate transportation the gas is taken through a liquefaction process. The liquefied natural gas, or "LNG", is formed by chilling very light hydrocarbons, e.g., hydrocarbons comprised primarily of methane, to approximately −163° C., where it is stored at ambient pressure in special cryogenic tanks Due to its low critical temperature, continued refrigeration is desired for LNG transportation and storage.

Upon delivery to an import terminal, the LNG is typically stored for later use and delivery to domestic markets. Experience shows that bulk storage of liquefied natural gas is most economical when stored in its fully refrigerated state, and at its bubble point at or near atmospheric pressure. The boiling point of LNG at one atmosphere is approximately −163° C. To accommodate this condition, insulated storage tanks are employed. The LNG storage tanks typically have a primary container and a surrounding secondary container.

For large volume storage of LNG, two distinct types of tank construction are widely used. The first of these is a flat-bottomed, cylindrical, self-standing tank that typically uses a 9% nickel steel for the inner tank and carbon steel, 9% nickel steel, or reinforced/prestressed concrete for the outer tank. The second type is a membrane tank wherein a thin (e.g. 1.2 mm thick) metallic membrane is installed within a cylindrical concrete structure which, in turn, is built either below or above grade on land. A layer of insulation is typically interposed between the metallic membrane, e.g., of stainless steel, and the load bearing concrete cylindrical walls and flat floor.

In the context of the cylindrical, self-standing LNG tank, and from a safety and environmental standpoint, it is preferred that the tank have "full containment." A "full containment" system requires that the outer secondary container hold both liquid and its vapor should the liquid escape from the primary container. The full containment system should also be configured to permit the controlled release or withdrawal of these fluid products from the system. While structurally efficient, cylindrical tanks in their state-of-practice designs are difficult and time consuming to build. LNG storage systems using self-standing 9% nickel steel tanks may require up to 36 months for construction. On many projects, this causes undesirable escalation of construction costs and length of construction schedule.

A need exists for a full containment LNG storage system that provides liquid and vapor integrity in the event of primary container leakage, and that can be efficiently fabricated. A need further exists for an improved method of fabricating a secondary container, such as an LNG container. A need further exists for prefabricated wall and roof panels that may be brought to a construction site for efficient erection of secondary container walls and roof structure.

SUMMARY

An LNG full containment system is provided. The LNG system generally comprises a floor slab, a primary container positioned on the floor slab, and a secondary container positioned around the primary container. The secondary container preferably incorporates the floor slab as part of its structure. The primary container is insulated in order to maintain a desired temperature within the primary container. For example, an insulating material such as pearlite is placed in the annulus between the outer side of the inner container and the inner side of the outer container.

The secondary container generally comprises a first end wall, a second end wall, and at least two side walls. At least one of the walls is fabricated from a plurality of prefabricated wall panels. Each of the prefabricated wall panels is fabricated from a combination of concrete and steel.

Preferably, each of the prefabricated wall panels includes a thin concrete plate having a longitudinal axis, and at least one steel beam connected to the concrete plate along the longitudinal axis of the concrete plate. In one embodiment, each wall panel includes a moisture barrier directly attached to the concrete plate opposite the at least one steel beam. Preferably, each wall panel is insulated by placing an insulation layer on the concrete plate or the moisture barrier, if a moisture barrier is installed. The insulation layer is preferably covered by a liner that is impervious to LNG and its vapor and that can withstand the cryogenic temperature of LNG such as thin sheets made of 9% Ni steel or stainless steel. The wall panels are preferably prefabricated offsite and then transported to the construction site where they are adjoined together in side-by-side fashion.

In another embodiment, a shallow-arch roof is provided that is also fabricated from a combination of steel and concrete roof panels. The roof panels also are preferably prefabricated offsite and then transported to the construction site where they are adjoined together in side-by-side fashion.

The present invention also provides a method for assembling an LNG full containment system. In one embodiment, walls and a roof as described above are provided. The walls are optionally constructed from wall panels prefabricated off-site. The prefabricated panels are then delivered to the tank site where they are adjoined together in side-to-side fashion according to desired dimensions.

In one embodiment of the method, a floor slab is first poured at the construction site. The slab is fabricated at least in part from concrete. A first planar end wall is erected on the floor slab. In addition, first and second planar side walls are erected on the floor slab, the first and second planar side walls being connected to the first end wall at opposite ends but being angled relative to the first end wall to leave an opening for receiving a second planar end wall so that a polygon having at least four sides may be formed. A roof structure is also constructed. The roof structure that covers the polygon formed by the end and side walls to provide a roof for a secondary container.

In accordance with the method, a primary container is also constructed. The opening within the secondary container is used as a means of access into the secondary container. In one aspect, one or more substantially completed primary containers is moved into the secondary container. Finally, a second planar end wall is erected so as to enclose the primary container within the secondary container.

BRIEF DESCRIPTION OF THE DRAWINGS

FIG. 7A shows the placement of a steel I-beam in a jig.

FIG. 7B shows illustrative formwork for the placement of concrete during fabrication of the wall panels.

FIG. 7C shows reinforcing cages being laid in the formwork of FIG. 7B.

FIG. 7D shows embedded plates and other aids used for the attachment of a moisture barrier, an insulation layer and the liner plate being placed alongside the steel reinforcing cages of FIG. 7C.

FIG. 7E demonstrates the pouring of concrete in the formworks containing the steel reinforcing cages, embedded plates and other construction aids of FIG. 7D.

Finally, FIG. 7F shows the attachment of various layers over the top surface of the cured concrete plate. Layers may include a moisture barrier layer, an insulation layer and a liner plate placed over the concrete plates of FIG. 7E.

FIG. 9A shows the formation of a concrete floor slab. In this embodiment, the footprint of the slab is rectangular. In addition, a vertical end wall has been erected over an end of the floor slab using prefabricated wall panels.

FIG. 9B presents the placement of a prefabricated roof panel on the concrete floor slab.

FIG. 9C is a cutaway view of the secondary container. In this step, the two opposing side walls have been erected along the floor slab. In addition, a roof structure has been placed over the span between the two opposing side walls to define the secondary container. A substantially complete primary container is being moved into its position within the secondary container.

FIG. 9D shows the same construction steps of FIG. 9C, but shows the secondary container in perspective view without a cutaway section.

FIG. 9E demonstrates that the primary container being moved into the secondary container. Finally, FIG. 9F shows the erection of the second vertical end wall to form the enclosed secondary container.

DETAILED DESCRIPTION

Definitions

Figure 2:
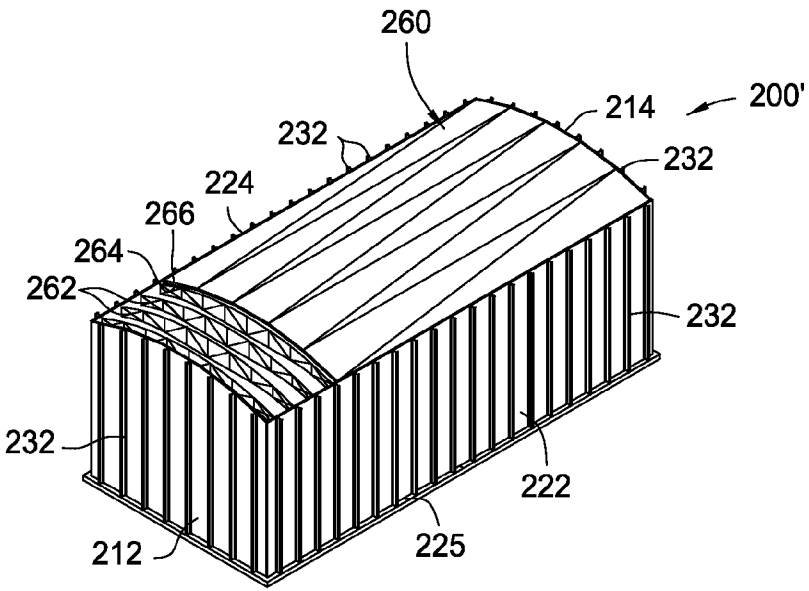
FIG. 2 provides an additional perspective view of an illustrative secondary container. A portion of an upper roof structure is peeled away to show roof trusses. A plurality of steel beams can be seen as part of the vertical end and side walls of the secondary container.

The following words and phrases are specifically defined for purposes of the descriptions and claims herein. To the extent that a term has not been defined, it should be given its broadest definition that persons in the pertinent art have given that term as reflected in printed publications, dictionaries or issued patents.

"Primary container" means an inner tank of an LNG containment system.

"Secondary container" means a tank that envelopes the primary container within an LNG containment system.

"Vertical panel" means a panel of a tank that is substantially vertical relative to a floor slab on which it is erected. "Panel" refers to any building block made of a combination of at least concrete and steel.

"End panel" means any substantially vertical panel at an end of a tank.

"Planar" means substantially planar, and does not exclude a surface that is slightly concave.

"Moisture barrier" means any sheet of material resistant to fluid penetration. A non-limiting example is a 3 mm sheet of carbon steel.

"Insulation layer" means any layer of material that provides thermal insulation to a concrete plate. A non-limiting example is a sheet of plywood. Another non-limiting example is a layer of polyurethane foam.

"Liner plate" means any sheet of material used to line the inner surface of an LNG container.

Description of Specific Embodiments

The following provides a description of certain specific embodiments of the present invention:

An LNG full containment system is first provided. The system includes a floor slab; a primary container positioned on the floor slab, the primary container being insulated to hold liquefied natural gas; and a secondary container peripherally positioned around the primary container, the secondary container comprising a plurality of composite walls attached to the floor slab, with each of the composite walls being formed from a plurality of prefabricated wall panels configured to be adjoined in side-to-side fashion. Each of the prefabricated wall panels includes a concrete plate having a longitudinal axis and an outer surface, and at least one steel beam connected to the outer surface of the concrete plate along the longitudinal axis of the concrete plate. Each of the plurality of composite walls of the secondary container has a first end wall, a second end wall, and at least two side walls, with each of the at least two side walls being disposed on opposing sides of the first end wall.

Preferably, each of the prefabricated wall panels further includes a moisture barrier disposed on the concrete plate opposite the at least one steel beam. Preferably, each of the prefabricated wall panels also further includes an insulation layer along the moisture barrier opposite the at least one steel beam, and a liner plate on the insulation layer. The moisture barrier may be fabricated from material selected from the group consisting of: a metallic material and a polymeric material.

The LNG full containment system may have a roof structure that includes a plurality of prefabricated roof panels adjoined in side-to-side fashion, with each of the roof panels including a concrete plate an inner surface, and a steel truss structure connected to the inner surface of the concrete plate.

A method of assembling an LNG full containment system is also provided. In one embodiment, the method includes the steps of pouring a floor slab fabricated at least in part from concrete; erecting a first end wall on the floor slab; erecting first and second side walls on the floor slab, the first and second side walls being connected to the first end wall at opposite ends, but being angled relative to the first end wall to leave an opening for receiving a second end wall so that a polygonal enclosure having at least four sides may be formed; providing a roof structure that is supported at least in part by the side walls; moving a substantially assembled primary container into the secondary container; and erecting the second end wall so as to enclose the primary container within the secondary container. The step of moving the substantially assembled primary container into the secondary container may be accomplished by using the opening for the second end wall as a means of access into the secondary container In one embodiment, the polygon is a four-sided polygon, and the first and second end walls and the first and second side walls connect together to form a rectangle. In another embodiment, the polygon is a six-sided polygon, the method further comprises the step of erecting third and fourth side walls on the floor slab, the third and fourth side walls being connected to the first and second side walls, respectively, but also being angled to preserve the opening for receiving the second end wall so that the six-sided polygon may be formed.

In one arrangement, the primary container comprises a plurality of planar, vertical walls, and the method further comprises the step of fabricating the vertical walls of the primary container at the same time that at least one of the side walls of the secondary container is being erected on the concrete floor slab.

In addition, a wall panel for a secondary container is provided. The secondary container is employed with a full containment LNG system. The wall panel may include a concrete plate having an inner surface, an outer surface, and a longitudinal axis; at least one steel beam connected to the concrete plate along the outer surface of the concrete plate, and along the longitudinal axis; and wherein the wall panel is configured so that a plurality of wall panels may be adjoined in side-to-side fashion so as to form a wall of a secondary container for the full containment LNG system. The wall panel preferably has an insulation layer disposed on the concrete plate opposite the at least one steel beam. Preferably, the wall panel also includes a moisture barrier along the insulation layer opposite the at least one steel beam, and a liner plate on the insulation layer.

Description of Embodiments Shown in the Drawings

Figure 1:
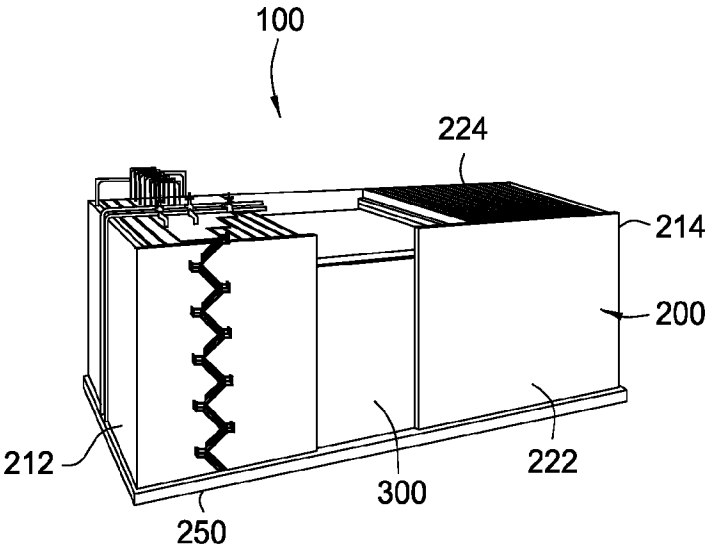
FIG. 1 presents a perspective, cutaway view of a containment structure. In the illustrative drawing of FIG. 1, an external "secondary container" of the containment structure is seen. In addition, an inner "primary container" is seen in the cutaway portion of the drawing.

The following provides a description of specific embodiments shown in the drawings:

FIG. 1 presents a perspective, cutaway view of a containment structure 100, in one embodiment. The containment structure 100, in its most general form, comprises an external secondary container 200 and at least one inner primary container 300. A primary container 300 is seen in the cutaway portion of the secondary container 200. The primary container 300 is designed to hold liquefied natural gas ("LNG") at cryogenic temperature and in an insulated manner. At the same time, the secondary container 200 is designed to serve as a "back-up" to the primary container 300 in the event that the primary container 300 loses fluid integrity.

A secondary container of an LNG storage system fulfills several functions. During normal operations, the outer, or "secondary" container holds the insulation in place and provides protection to the inner, primary tank against the elements of nature. Under extreme conditions when the inner tank is assumed to fail and no longer able to hold the cryogenic liquid, the outer tank is called upon to hold full contents of the inner tank safely and to permit both controlled withdrawal of the contained liquid and controlled release of the product vapor. In this event, a severe set of loads is imposed on the outer tank. Not only is the outer tank subjected to the hydrostatic loads applied by the liquid now contained by it, but the outer wall is also subjected to a 'thermal shock' loading due to sudden exposure to the very low temperatures of the LNG liquid. The inner wall and floor surfaces of the secondary container experience a sudden and severe drop of temperature while the outer surfaces of the secondary container wall remain exposed to ambient temperature. This causes severe stresses in the secondary container at junctures such as wall-floor interfaces. Thus, a secondary container 200 is preferably designed to accomplish one or more of the following: (1) withstand hydrostatic forces upon fluid leakage from the primary container 300, (2) contain liquids that might escape from the primary container 300, (3) provide gas tightness from gases that will form when liquid escapes from the primary container 300, and (4) withstand thermal shock created if and when extremely cold fluids from the primary container 300 contact the inner surfaces of the secondary container 200.

In the arrangement of FIG. 1, the secondary container 200 defines a polygonal structure having a plurality of walls. More specifically, the secondary container 200 has a first end wall 212 and a second opposite end wall 214. In addition, the container 200 has at least two opposite side walls disposed intermediate the first 212 and second 214 end walls. One of the side walls is seen at 222, while a second side wall is on the back side and not directly visible, but is nevertheless referenced at 224. The secondary container 200 further includes a bottom floor slab 250 and a roof structure 260. The end walls 212, 214, the at least two side walls 222, 224, the floor slab 250 and the roof structure 260 form an enclosure for the primary container 300.

In the arrangement of FIG. 1, the polygonal form of the secondary container 200 is a four-sided structure, forming a rectangle. However, the four-sided structure could also be a square. Alternatively, the polygonal form of the secondary container 200 could be formed from more than 4 sides, for example, a six-sided or an eight-sided structure (not shown). In such an arrangement, the secondary container 200 would have additional opposing side walls (not shown) between side walls 222, 224 and end panel 214, respectively. The various end and side walls may or may not have the same length, and may or may not be precisely linear.

FIG. 2 provides an additional perspective view of an illustrative secondary container 200'. A rectangular enclosure is again provided. A plurality of steel beams 232 can be seen as part of the four vertical walls 212, 214, 222, 224 of the secondary container 200'. A concrete floor slab 250 is provided under the walls 212, 214, 222, 224. An upper roof structure 260 is peeled away to show equidistantly spaced roof trusses 262.

The secondary container 200 of FIG. 1 employs vertical wall structures. Preferably, the first and second end walls 212, 214 and the side walls 222, 224 are erected on-site over the secondary tank bottom 225. Each wall is substantially vertical and, preferably, substantially planar.

Figure 3:
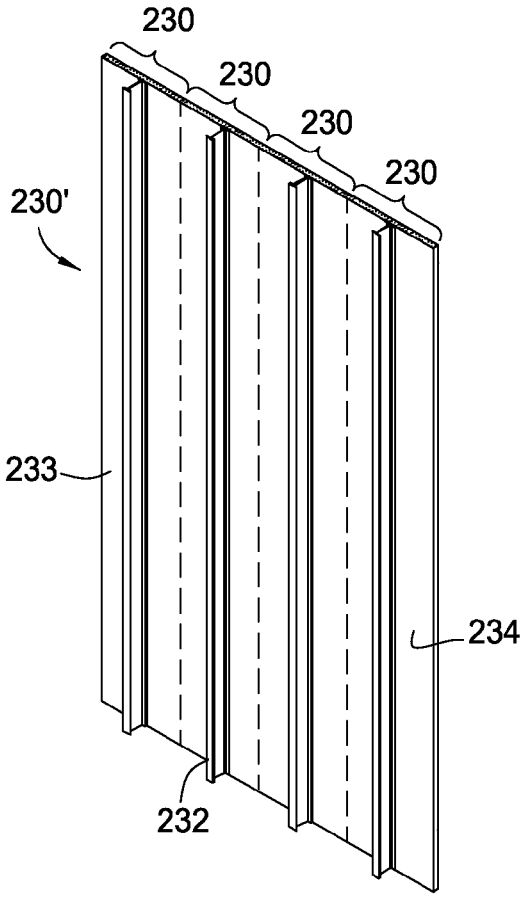
FIG. 3 shows a series of individual prefabricated panels that may be used for assembling vertical walls of the secondary container, in one embodiment. The panels are mated in side-to-side fashion.

To aid in the efficient erection of the various walls 212, 214, 222, 224 prefabricated panels are preferably employed. FIG. 3 shows a series of individual panels 230' that may be used for assembling vertical walls of the secondary container 200, in one embodiment. The vertical panels 230' are a combination fabrication, meaning that they are formed from a combination of steel and concrete. In the arrangement of FIG. 3, each panel 230 has at least one I-beam 232 adjoined to a thin concrete plate 234. The steel beam 232 may be prefabricated, or may be built-up by welding or otherwise attaching plates to form a beam. In one embodiment, the panels 230 are adjoined in such a manner that the beams 232 are spaced at 5 m intervals.

In one embodiment, the concrete plate 234 is pre-formed by pouring concrete into a mold, with the cured plate 234 being about 100 mm thick to about 500 mm thick. In another embodiment, the plate 234 is about 200 to 400 mm thick, or alternatively, approximately 250 mm to 350 mm thick. The I-beams 232 are attached to the concrete plates 234 along an outer surface 233 to provide lateral structural support. The laterally supported thin-wall arrangement has advantages over the thick, one-meter concrete walls sometimes seen in modern cylindrical tanks. In this respect, thicker walls induce large and prolonged through-thickness, non-linear, thermal gradients, resulting in large, thermally-induced stresses. The individual wall panels 230 may optionally be poured as a group of panels 230', such as 2, 3, 4 or more panels 230 to form a structurally monolithic panel 230'. Thus, the "smallest building block" may be a panel 230, or a panel 230'.

Figure 4:
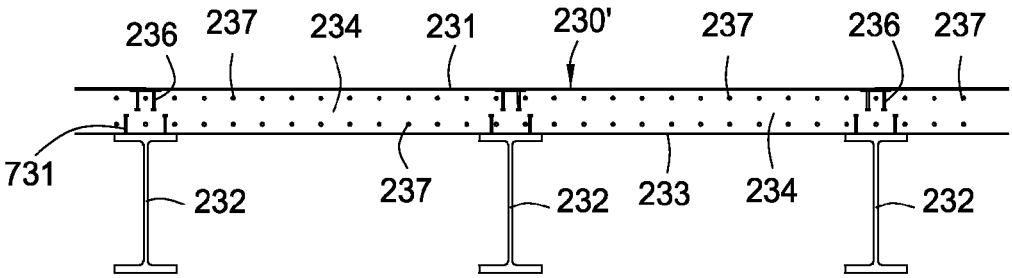
FIG. 4 provides a top view of a portion of the panels of FIG. 3.

FIG. 4 provides a top view of a portion of the panels 230' of FIG. 3. Visible in FIG. 4 are three spaced-apart I-beams 232 butted against concrete plates 234. Metal plates 236 are optionally embedded into the concrete plates 234 for receiving additional layers onto the inner surface of the plates 234, as will be described below. In one arrangement, the embedded metal plates 236 extend 100 mm into the concrete plates 230. Also visible in FIG. 4 are the ends of steel bars 237. The optional steel bars 237 act as "rebar," and serve to reinforce the plate 230.

Figure 5:
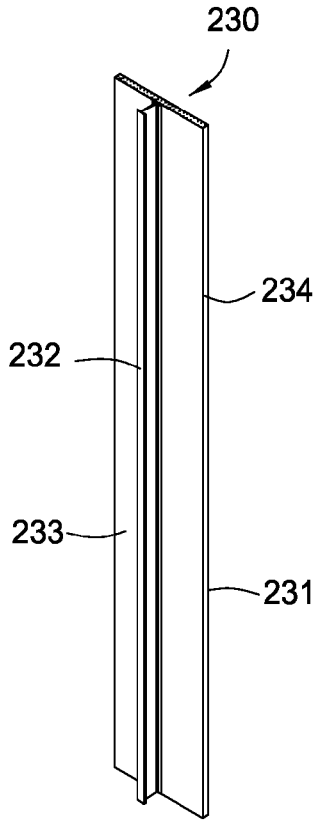
FIG. 5 presents a perspective view of a single panel from FIG. 3. In one embodiment, the single, prefabricated panel represents the smallest building block of the combination wall units.

FIG. 5 presents a single panel 230 from the panels 230' of FIG. 3, in one embodiment. The panel 230 represents one possible "smallest building block" of the combination wall units as might be used in constructing an LNG containment system 100. A plurality of individual panels 230, e.g., four, may be fabricated as a unit in a casting yard for delivery to a construction site. The number of "smallest building blocks," i.e., individual wall panels 230 or groups of panels 230', that are fabricated as a unit depends on a number of factors, such as casting yard capabilities and on-site handling and lifting equipment. In one possible arrangement, for a 95 m long×45 m wide×35 m high structure with concrete plate thickness of 350 mm and a steel beam spacing of 5 m, which is calculated to be a satisfactory secondary container in one embodiment of a 100,000 $m^3$ rectangular LNG containment system, a building unit of four "smallest building blocks" is preferred.

Figure 6:
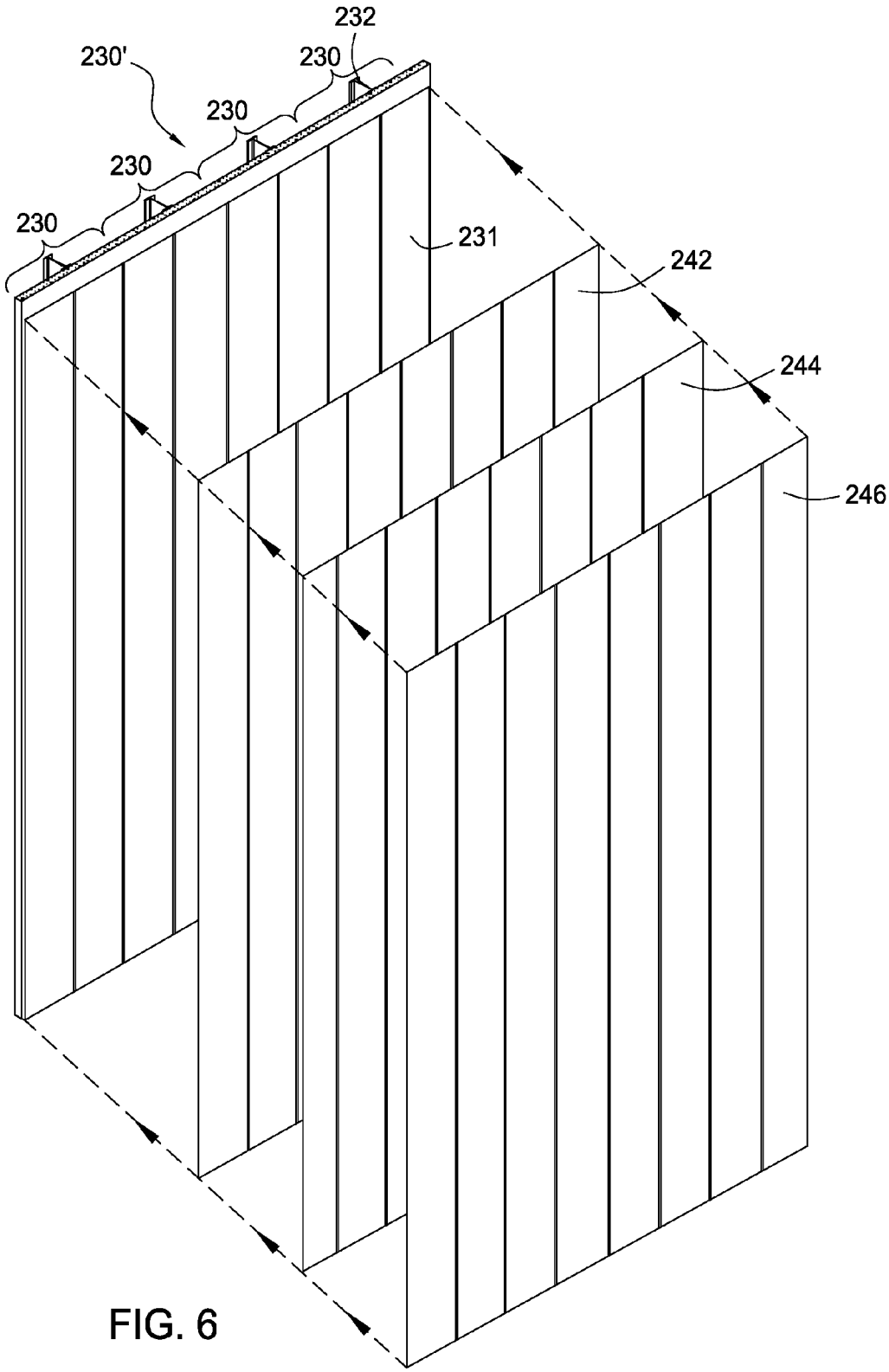
FIG. 6 is a perspective view of the panels of FIG. 3, seen from the opposite side. Here, the face or "inner surface" of the combination panels is seen, with the panels again being mated in side-to-side fashion.

FIG. 6 is a perspective view of the panels of FIG. 3, seen from the opposite side. Here, inner faces 231 of the combination panels 230' are seen. A group of panels 230' are fabricated as a single unit. Each inner face 231 may receive additional layers onto the concrete panel 230. First, a moisture barrier 242 may be placed onto the inner face 231, i.e., along the concrete panel 230' opposite the at least one steel beam 232. The moisture barrier 242 is preferably fabricated from either a metallic material or a polymeric material. Second an insulation layer 244 may be disposed on the moisture barrier 242. Preferably, the insulation layer 244 is a 5 cm layer of a cryogenic insulation material such as polyurethane foam. The insulation layer 244 helps to lessen the severity of initial thermal gradient during a thermal shock event, and to limit the temperature extremes that the wall is subjected to. Finally, a liner plate 246 may be placed onto the panel 230', preferably over the insulation layer 244. The liner plate 246 is preferably a nickel steel alloy, such as a 5-6 mm thick plate of 9% Nickel steel. In FIG. 6, layers of a moisture barrier 242, an insulation layer 244, and a liner plate 246 are shown exploded from the concrete panels 230'.

As noted, the various combination panels 230 are joined to form a wall of any desired length. When assembling walls 212, 214, 222 and 224 for the secondary container 200, the panels 230' are erected in a vertical orientation over a floor slab, such as a concrete floor slab. A floor slab is seen at 250 in FIG. 1. The floor slab 250 provides a fixed base for the containment structure 100. The floor slab 250 preferably has a 9% nickel steel or other cryogenic material liner 225 on top to cover the foundation slab 250. Additionally, the floor slab may have a moisture barrier and an insulation layer on top of the foundation slab 250 as previously discussed for the concrete panels 230'. Such a combination of liners may also be placed on the end and side walls up to a height of 3 to 5 meters as corner protection against thermal expansion.

The steel beam/concrete combination walls 212, 214, 222, 224 are connected to the floor slab 250. In one embodiment, a "pin" connection is provided between the panels 230' and the slab 250. The liner plate 246 on the panels 230 is joined to the liner plate 225 on secondary tank bottom 250 such that a liquid tight secondary containment is obtained. The steel beams 232 and the exterior surface 233 of the panels 230' are in some instances coated with fire proofing materials to enhance their integrity against fire.

In practice, the floor slab 250 receives not only the various end 212, 214 and side 222, 224 walls, but also supports the primary container 300. Preferably, a bottom insulation layer is interposed between the concrete floor slab 250 and the steel inner tank bottom 225 by placing insulation materials (not shown) in the annular space (also not shown) between the inner 300 and outer 200 tanks.

The walls 212, 214, 222, 224 of the outer tank 200 of the present invention are designed to contain the liquid product, i.e., LNG, in the event of a large leak from the primary inner container 300. The external vertical steel beams 232 carry a large portion of the hydrostatic loads of LNG if and when the liquid from the primary tank 300 leaks out. The concrete sections 234 of the walls 212, 214, 222, 224 induce relatively small thermal stresses due to the thermal shock at initial contact with LNG. Preferably, the walls are "thin," having a thickness of about 100 mm to 500 mm. In one embodiment, the concrete plate 234 is 350 mm to 400 mm in thickness. The thin walls are capable of surviving the thermal shock loads without insulation or any other mitigation. A full height steel liner 246, with a partial or full height insulation layer 244, assures leak tightness and aids in stress management during thermal shock. By so splitting the functional duties of strength provision, liquid containment and liquid and gas leak tightness, and forbearance of thermal shock induced stresses, the wall structure achieves efficiency when contrasted with traditional solutions that ascribe fulfillment of all these requirements to a thick (e.g., greater than 600 mm), post-tensioned wall installed on a fixed concrete base.

Figure 7A:
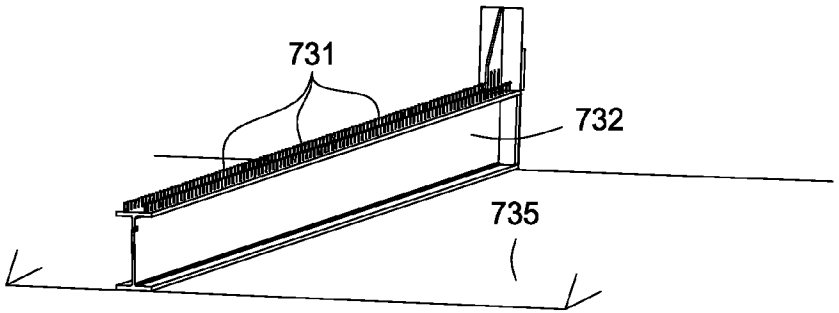
FIGS. 7A-7F present sequential steps for assembling a wall panel as may be used in the construction of walls for the secondary container, in one embodiment.

FIGS. 7A-7F present sequential steps for assembling a panel 230 as may be used in the construction of walls for the secondary container 200, in one embodiment. FIG. 7A shows the placement of a steel I-beam 732. The beam 732 defines an elongated support member. Preferably, the beam 732 includes one or more small pins 731. The pins 731 extend along a side of the beam 732, and are generally enveloped by concrete during panel fabrication. The pins 731 serve to further secure the beam 732 to the cured concrete plate, seen FIG. 7F). In FIG. 7A, the beam 732 has been placed in a jig 735. The jig 735 serves as the bottom formwork for supporting plate-forming operations.

Figure 7B:
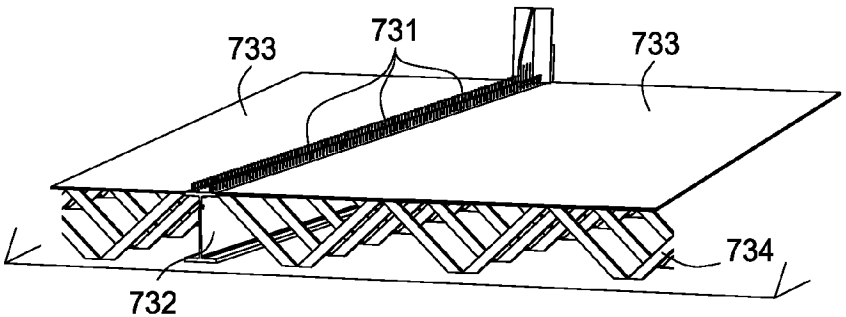

FIG. 7B presents a plurality of truss brackets 734 positioned transverse to the single I-beam 732 of FIG. 7A. The truss brackets 734 provide a support for the wall panel fabrication operation. In the arrangement of FIG. 7B, form plates 733 have been laid on opposing sides of the beam 732. Pins 731 extend upward intermediate the form plates 733. The form plates 733 serve as an impermeable base over which concrete is later poured. The form plates 733 may become a permanent inner layer along the concrete plates 738, though preferably they stay in the jig 735 and are not a permanent part of a panel 730.

Figure 7C:
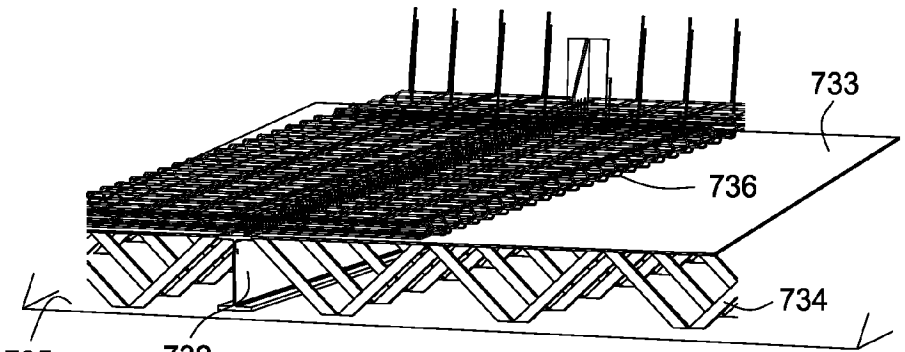

FIG. 7C shows a next step in the panel-forming operation. Here, reinforcing cages 736 are being laid. The form plates 733 assist in supporting the cages 736. The cages 736 are preferably fabricated from steel. The cages 736 receive poured concrete (see the panel-forming step of FIG. 7E). In this manner, the cages 736 serve as "rebar" to strengthen the formed panel.

Figure 7D:
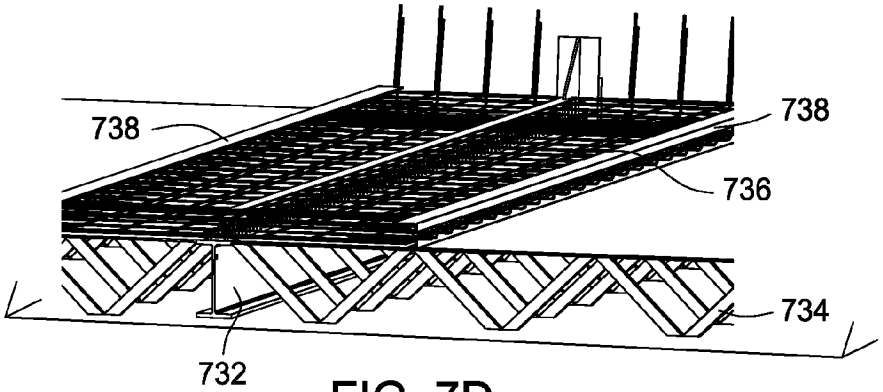
Figure 7E:
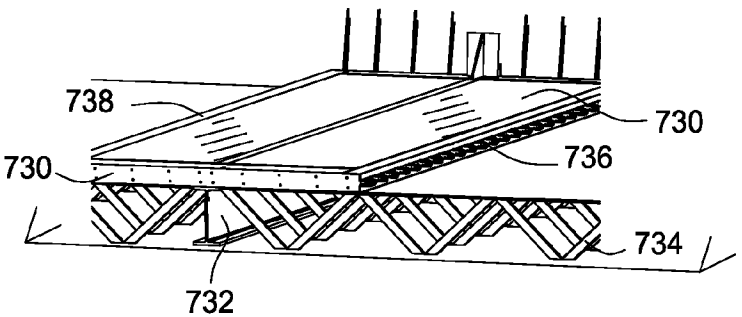

A next step in the panel-forming operation is seen in FIG. 7D. FIG. 7D shows embedded plates 738 being placed over the edges of the cages 736 of FIG. 7C. Reinforcing cages 736, and embedded plates 738 are placed in the jig 735 and appropriately connected together by welding or fastening by other means. FIG. 7E demonstrates the pouring of concrete in the formwork of FIG. 7D. The concrete is allowed to cure to form a panel 730.

Figure 7F:
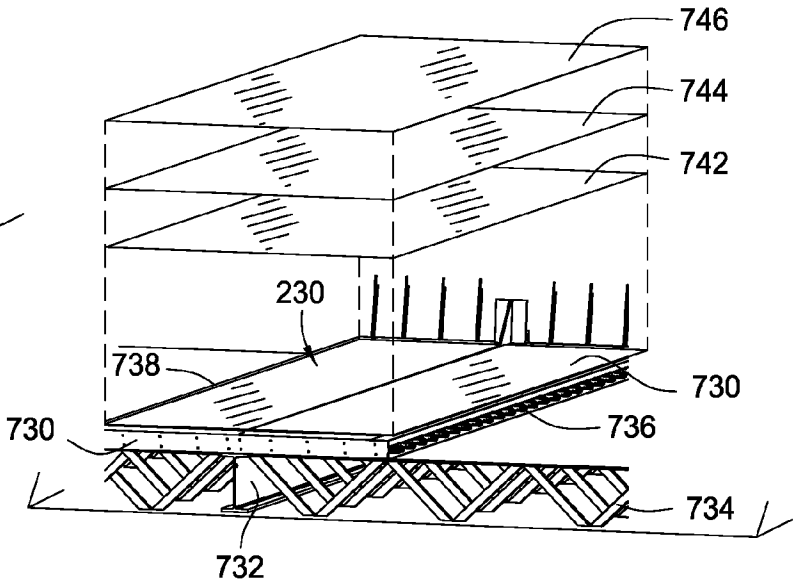

Finally, FIG. 7F shows the attachment of various layers 742, 744, 746 over the top surface of the cured concrete panel 730. Layers may include a moisture barrier layer 742, an insulation layer 744, and a liner plate 746 placed over the concrete panels of FIG. 7E. The moisture barrier 742, the insulation layer 744, and the liner plate 746 are again shown exploded from the concrete panel 230. Preferably, these fabrication steps would take place in a concrete casting yard. After assembly, the precast wall sections 230 are moved to the construction site (not shown).

A roof structure 260 is also provided on the secondary container 200. The roof structure 260 may be assembled by adjoining roof panels in side-to-side (including end-to-end) fashion as with the wall panels described above.

First, referring again to FIG. 2, this Figure shows an additional perspective view of an illustrative secondary container 200'. In accordance with the above descriptions, a plurality of steel beams 232 is provided along vertical end walls 212, 214 and side 222, 224 walls of the secondary container 200'. In addition, an upper roof structure 260 is provided. The roof structure 260 is convex relative to the exterior of the container 200', and in this embodiment forms a shallow arch. In the view of FIG. 2, the roof structure 260 is peeled away to show several spaced-apart roof trusses 262. The roof trusses 262 span the secondary container 200 across the opposing side walls 222 and 224. Concrete panels 266 are placed over the trusses 262. A carbon steel plate 264 spanning the entire width and length directions of the secondary container structure 200 is optionally under the concrete panels 266. As noted above, the roof structure 260 may be fabricated by adjoining pre-poured concrete roof panels in side-to-side fashion. Alternatively, the roof structure 260 may be formed by first installing the trusses 262, followed by installation of the liner 264, and then pouring a topping layer of concrete on top of the liner 264. The concrete is poured in place with the liner 264 serving as part of the formwork.

Figure 8:
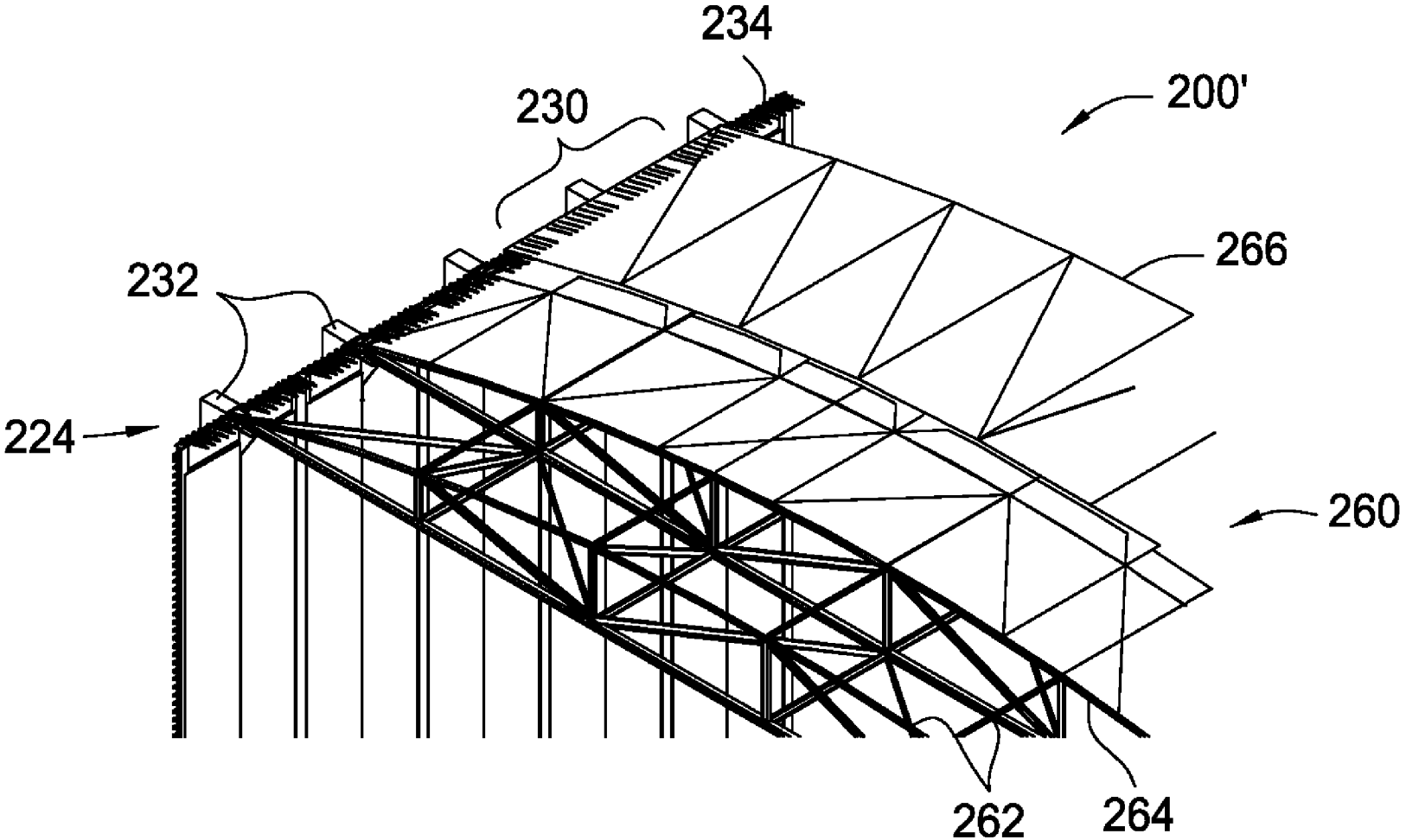
FIG. 8 is an enlarged perspective view of a portion of the containment system from FIG. 2. Visible in this view are steel trusses with reinforced concrete roof panels being placed there over. Vertical side panels in accordance with the panels of FIG. 3 are also visible, supporting the steel roof trusses.

FIG. 8 provides an enlarged perspective view of a portion of the containment system 200 from FIG. 2. Visible in this view are the steel trusses 262 with thin, reinforced concrete roof panels 266 having been placed there over to form the roof structure 260. A moisture barrier plate 264 is again disposed between the trusses 262 and the concrete plates 266. Vertical side panels 230 in accordance with the panels 230 of FIG. 3 are also visible, supporting the steel roof trusses 262 and forming a side wall 224.

The roof structure 260 of the secondary container 200 is a steel/concrete combination construction. In the embodiment of FIGS. 2 and 8, the roof structure 260 is shaped to provide a shallow arch configuration in the width direction of the structure 200. Uniformly spaced steel trusses 262 spanning the width of the secondary container 200, with their spacing matching the spacing of the vertical steel beams 232 of the side walls 222, 224 are attached to these beams 232 at their upper termini. A carbon steel plate 264 spanning the entire width and length directions of the secondary container structure 200 is installed atop and attached to the upper extremities of the roof trusses 262. The carbon steel plate 264 serves as the moisture and vapor barrier when the structure 200 is completed. A layer of reinforced concrete 266 is installed over the trusses 262 and the carbon steel plate 264.

The roof structure arrangement 260 of FIGS. 2 and 8 allows partial prefabrication. In this respect, the steel trusses 262 and steel plate 264 may be fabricated off-site. A roof "building block" may be composed of two, three, or more trusses. These "prefabricated truss panels may be delivered to the tank construction site to aid in a more efficient secondary tank construction operation. For example, first the steel truss 262 and steel plate 264 roof building block may be installed so that the steel trusses 262, with their spacing matching the spacing of the vertical steel beams 232 of the side walls 222, 224, are attached to these wall beams 232 at their upper termini. Then the concrete plates 266 of the roof structure 260 may be formed by pouring concrete on top of the steel plate 264 of the roof building block. Post tensioning of the roof concrete layer 266 may not be necessary in these arrangements.

In addition to providing a secondary container for an LNG containment system 100, a method is also provided herein for assembling an LNG containment system, such as system 100. Construction of containment system 100 is expedited by using the above-described secondary container embodiments 200. The secondary container 200 is erected over a concrete tank floor (seen at 250 in FIG. 1). More specifically, individual walls, e.g., end walls 212, 214 and side walls 222, 224 are formed by vertically erecting and attaching various panels (shown at 230 in FIG. 3) side-by-side. This is a segmental technique that uses off-site prefabrication of building blocks that can be assembled into a structural system.

Known full containment systems typically demand a relatively long construction schedule. The sequential construction of storage system elements normally starts with the construction of a cast-in-place outer tank slab and walls. Only after the domed roof has been constructed on the outer tank walls is construction on the internal structures, including the bottom insulation and inner steel tank, started. This means that the inner steel tank is constructed in-situ after the secondary container has been at least substantially completed. A construction schedule of 36 months for a now typical 160,000 $m^3$ full containment LNG storage tank is normal. This long construction schedule is often on the critical path for an LNG facility construction project, causing a potential source of delay. Therefore, an improved method for assembling an LNG containment system is offered.

Figure 9B:
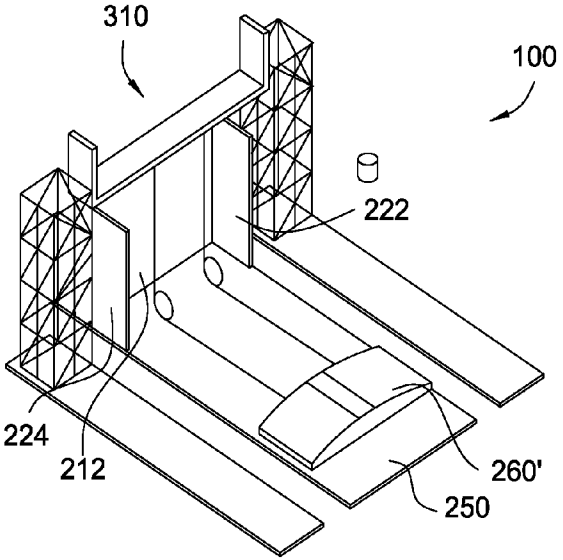
FIGS. 9A-9F present sequential steps for construction of a secondary container, in one embodiment.
Figure 9C:
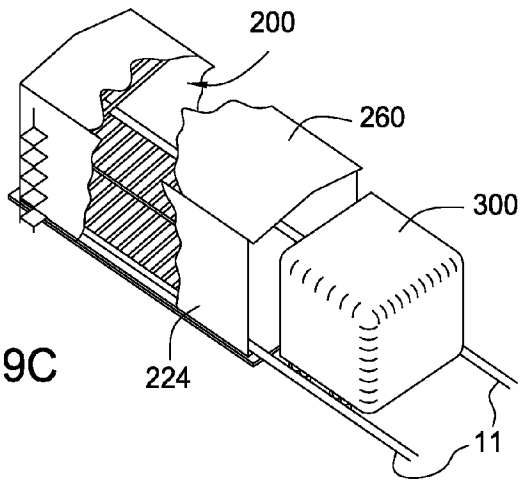
Figure 9A:
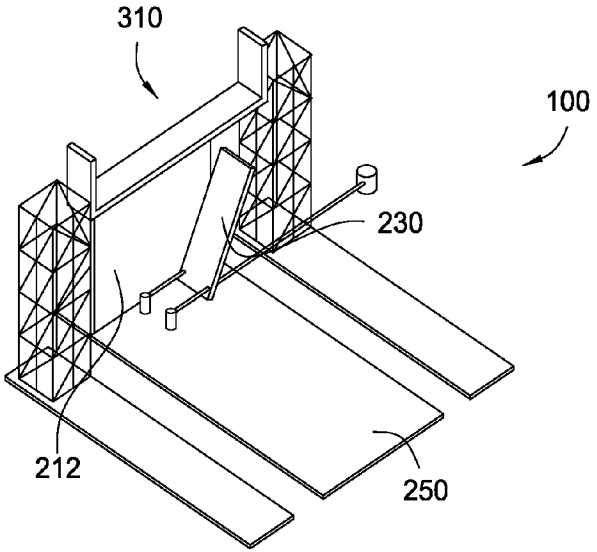

FIGS. 9A-9F present sequential steps for construction of a full containment LNG tank 100, in one embodiment. The full containment tank 100 will include one or more inner tanks 300 and a surrounding outer tank 200. First, FIG. 9A shows the formation of a concrete floor slab 250. In this embodiment, the "footprint" of the slab 250 is rectangular. In addition, a vertical end wall 212 has been erected over an end of the floor slab 250. The end wall 212 has been assembled by adjoining prefabricated combination wall panels (such as those shown at 230 in FIG. 3) in side-to-side fashion. The wall panels 230' may be individual wall panels 230, or may be a structurally monolithic collection of wall panels 230' fabricated in a casting yard to form a single "panel." The wall panels 230 are tilted up into vertical position using lifting equipment (not shown). The panels are aligned and braced, and interconnected to form the end wall 212. Structural connection between the floor slab 250 and the wall panels 230 forming end wall 212 is then provided.

In FIG. 9A, scaffolding 310 has been erected. The scaffolding 310 assists in the lifting, aligning, bracing and interconnecting of prefabricated wall panels 230'. However, the methods for constructing an LNG containment system claimed herein are not limited in scope by the type of equipment used for the construction.

Next, panels forming the side walls 222, 224 are installed similar to the end wall 212. This means that the side walls 222, 224 are lifted up into vertical position. The side panels are aligned and braced, and interconnected to form the respective side walls 222, 224. The side walls 222, 224 are then connected to the floor slab 250 and the adjoining panels of the end wall 212. In FIG. 9A, a first wall panel 230' is seen being raised for a side wall.

Construction of a roof structure 260 follows closely behind the side wall construction. In one embodiment, prefabricated combination roof panels (such as those shown at 260' in FIG. 9B) are erected onto wall panels 230' as the side walls 222, 224 are being formed. FIG. 9B presents the placement of a prefabricated roof panel 260' on the concrete floor slab 250. As sufficient numbers of side wall panels are installed, the roof truss units with concrete plates (roof panels 260') are brought in, lifted in place and structurally connected to the walls 222, 224 and adjoining roof panels 260'. Construction continues until one end wall 212, two side walls 222, 224 and a roof structure (seen at 260 in FIG. 9C) is completed.

FIG. 9C is a cutaway view of the secondary container 200. In this step, the two opposing side walls 222, 224 have been erected along the floor slab 250. In addition, a roof structure 260 has been placed over the span between the two opposing side walls 222, 224 to define the secondary container 200. One end of the secondary container 200 is left open for installation of the inner tank 300. A substantially complete primary container 300 has been moved into its position within the secondary container 200. The inner tank may be insulated by providing a bottom insulation layer interposed between the concrete floor slab and steel tank bottom.

Figure 9E:
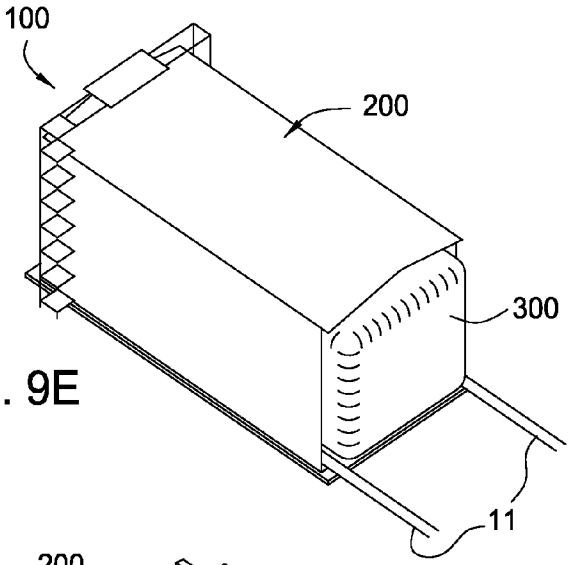
Figure 9F:
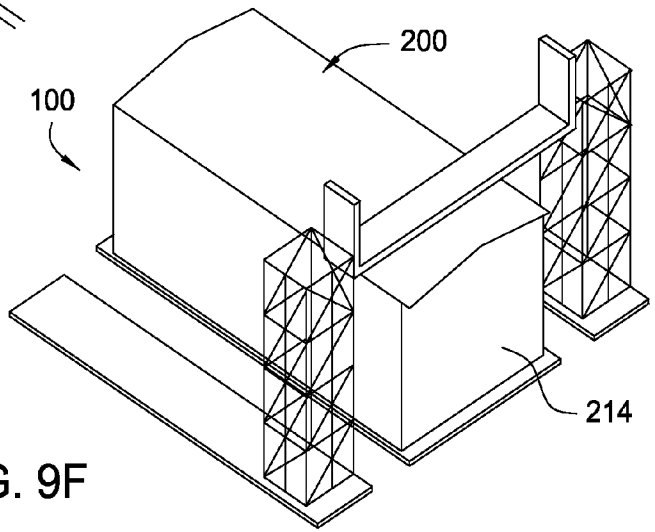
Figure 9D:
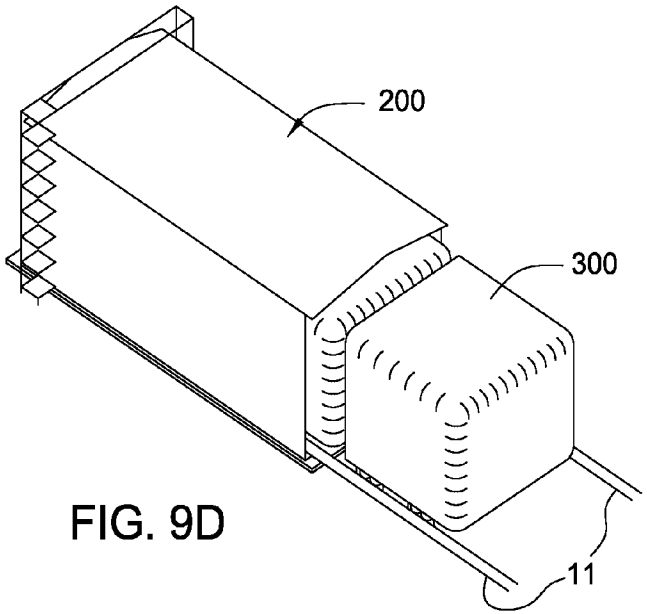

FIG. 9D shows another primary container 300 being rolled into the secondary container 200. In this respect, a secondary container may hold more than one primary container, in a linear arrangement.

FIG. 9E demonstrates that the second primary container 300 has been substantially moved into the secondary container 200. Additional insulation materials may be placed in an annular space (not shown) formed between the inner 300 and outer 200 tanks.

Finally, FIG. 9F shows the erection of the second vertical end wall 214 to form the enclosed secondary container 200. The two parallel tracks 11 have been removed. A full containment LNG container system 100 has been assembled in an efficient manner. The above procedure permits parallel construction of the inner 300 and outer 200 tanks, thus reducing the construction schedule considerably.

A description of certain embodiments of the inventions has been presented above. However, the scope of the inventions is defined by the claims that follow. Each of the appended claims defines a separate invention, which for infringement purposes is recognized as including equivalents to the various elements or limitations specified in the claims.

What is claimed is:

1. A method of assembling an LNG full containment system, comprising the steps of:

pouring a floor slab of a secondary container fabricated at least in part from concrete;

erecting a first end wall on the floor slab;

erecting first and second side walls on the floor slab, the first and second side walls being connected to the first end wall at opposite ends, but being angled relative to the first end wall to leave an opening for receiving a second end wall so that a polygonal enclosure having at least four sides formed, wherein each of the end walls and each of the side walls are formed from a plurality of prefabricated wall panels configured to be adjoined in side-to-side fashion, wherein each of the prefabricated wall panels is formed from a combination of steel and concrete such that the prefabricated wall panel comprises:

a concrete plate having a longitudinal axis and an outer surface, and at least one steel beam connected to the outer surface of the concrete plate along the longitudinal axis of the concrete plate, providing a roof structure that is supported at least in part by the side walls;

moving a substantially assembled primary container into a secondary container by using the opening for the second end wall as a means of access into the secondary container; and erecting the second end wall so as to enclose the primary container within the secondary container.

2. The method of claim 1, wherein each of the prefabricated wall panels further comprises:

a moisture barrier disposed on the concrete plate opposite the at least one steel beam.

3. The method of claim 2, wherein each of the prefabricated wall panels further comprises:

an insulation layer along the moisture barrier opposite the at least one steel beam; and a liner plate on the insulation layer.

4. The method of claim 3, wherein the moisture barrier is fabricated from either a metallic material or a polymeric material.

5. The method of claim 1, wherein:

the roof structure is fabricated by adjoining prefabricated roof panels in side-to-side fashion, with each of the prefabricated roof panels comprising:

a concrete plate having an inner surface, and a steel truss structure connected to the inner surface of the concrete plate.

6. The method of claim 1, wherein said providing a roof structure includes:

providing a steel truss structure that is supported at least in part by the side walls;

providing a steel plate on top of said steel truss structure; and pouring concrete onto said steel plate thereby forming a concrete plate having an inner surface and a steel truss structure supporting to the inner surface of the concrete plate.

7. The method of claim 1, wherein:

the polygon is a four-sided polygon; and the first and second end walls and the first and second side walls connect together to form a rectangle.

8. The method of claim 1, wherein:

the polygon is a six-sided polygon; and the method further comprises the step of erecting third and fourth side walls on the floor slab, the third and fourth side walls being connected to the first and second side walls, respectively, but also being angled to preserve the opening for receiving the second end wall so that the six-sided polygon may be formed.

9. The method of claim 1, wherein:

the primary container comprises a plurality of planar, vertical walls; and further comprising the step of fabricating the vertical walls of the primary container at the same time that at least one of the side walls of the secondary container is being erected on the concrete floor slab.

10. A method for assembling an LNG full containment system, comprising the steps of:

pouring a floor slab fabricated at least in part from concrete;

erecting a plurality of vertical walls on the floor slab by adjoining a plurality of prefabricated wall panels in side-to-side fashion, with each of the prefabricated wall panels being formed from a combination of steel and concrete such that the prefabricated wall panel comprises a concrete plate and at least one steel beam attached to an outer surface of the concrete plate along the longitudinal axis of the concrete plate, but leaving an opening so that the plurality of vertical walls is not enclosed;

constructing a roof structure that covers the plurality of vertical walls to provide a roof for a secondary container, the roof structure being assembled by adjoining a plurality of prefabricated roof panels in side-to-side fashion, with each of the prefabricated roof panels being fabricated from a steel truss structure, and at least one concrete plate above the steel truss structure;

moving a substantially assembled primary container into a secondary container using the opening between the plurality of vertical walls as a means of access into the secondary container; and erecting at least one final vertical wall on the floor slab so as to form a polygon having at least four sides and so as to enclose the primary container within the secondary container.

11. The method of claim 10, wherein each of the prefabricated wall panels further comprises:

a moisture barrier disposed on the concrete plate opposite the at least one steel beam.

12. The method of claim 11, wherein each of the prefabricated wall panels further comprises:

an insulation layer along the moisture barrier opposite the at least one steel beam; and a liner plate on the insulation layer.

13. The method of claim 12, wherein the moisture barrier is fabricated from either a metallic material or a polymeric material.

* * * * *